United States Patent [19]

Adamski, Jr. et al.

[11] 4,098,201

[45] Jul. 4, 1978

[54] METHOD AND APPARATUS FOR HEMMING

[75] Inventors: Maximilian Adamski, Jr., Wheeling; Robert E. Smith, Crystal Lake; Dhimat R. Desai, Palatine, all of Ill.

[73] Assignee: Union Special Corporation, Chicago, Ill.

[21] Appl. No.: 733,604

[22] Filed: Oct. 18, 1976

[51] Int. Cl.[2] ..... D05B 21/00

[52] U.S. Cl. ..... 112/2; 112/121.15; 112/121.26; 112/153; 112/263; 112/141

[58] Field of Search ..... 112/121.11, 121.12, 112/121.15, 121.26, 121.29, 262, 63, 2, 203, 141, 143, 153

[56] References Cited

U.S. PATENT DOCUMENTS

| | | | |
|---|---|---|---|
| 3,736,895 | 6/1973 | Farrar et al. | 112/203 |
| 3,783,805 | 1/1974 | Guichard | 112/121.26 |
| 3,865,058 | 2/1975 | Rouin et al. | 112/63 |

*Primary Examiner*—H. Hampton Hunter

*Attorney, Agent, or Firm*—John A. Schaerli; John W. Harbst

[57] ABSTRACT

Device includes a fabric carrying and feeding means, fabric tensioning means, fabric orientating means, particular means which aid in performing the sewing function and the sewing machine.

17 Claims, 23 Drawing Figures

NCL 9
24
134
50
22
48
76
84
81
87
86
74
56
80
58
62
70
59
66
68
122
14
128
130
116
119
120
106
118
109
92
94
78
96
79
117
60
115
113
111

37
22
38
204
42
36
176
41
203
202
34
200
178
198
162
160
174
158

20
254
250
252
272
270
268
228
232
22
222
294
226
236
240
202
238
230
220
302
224
234
284

250
254
256
260
252
258
310
262
264
280
272
276
274
268
278
281
266
270
B
242
238
244
248
294
308
296
312
288
290
292
304
286
314
306
284
240
202
302
222
246
22
NCL
230

FIG. 22 — BOTTOM HEMMER MECHANICAL SEQUENCE CHART
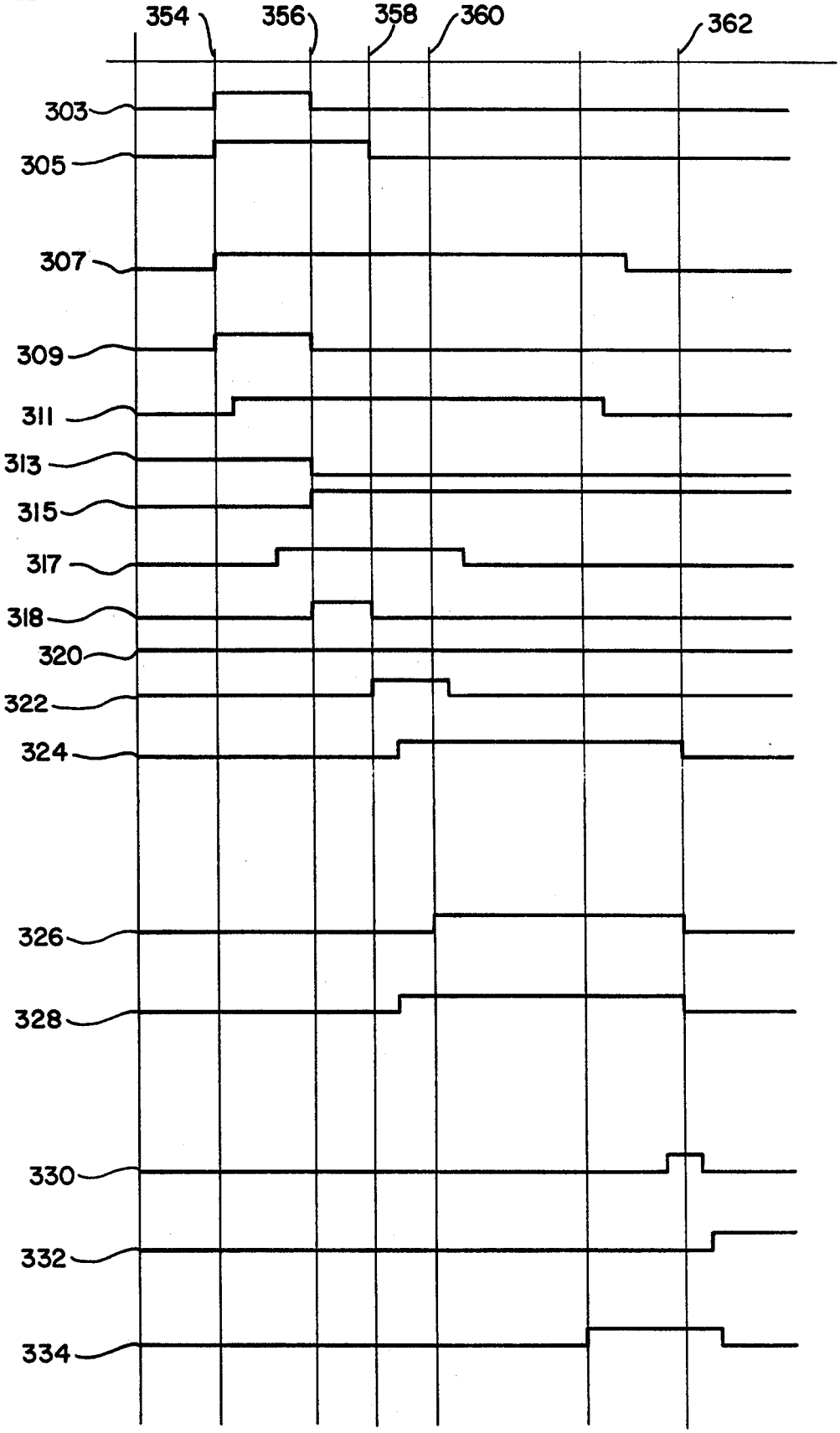

METHOD AND APPARATUS FOR HEMMING

This invention relates to automatic hemming and more particularly to a method and an apparatus for automatically hemming a fabric piece.

BACKGROUND OF THE INVENTION

Until recently a substantial portion of the bottom hemming operations were performed manually with some form of mechanical assist. A number of automatic hemming apparatuses are now available as evidenced in Kosrow et al U.S. Pat. No. 3,786,768; Farrar U.S. Pat. No. 3,736,895 and Guichard U.S. Pat. No. 3,783,805, for examples. Such devices incorporate manual steps to some degree or another in conjunction with automatic system steps. These systems, although being partially acceptable, do not achieve complete superiority over basically manual devices.

SUMMARY OF THE INVENTION

In accordance with the present invention, a method and apparatus is provided whereby once a fabric means has been loaded onto the apparatus a series of steps are automatically performed by the apparatus to hem the bottom of the fabric means. Additional automatic devices can also be provided to aid loading the fabric means and removing the hemmed product from the apparatus. The operator need only position, to a certain degree, the fabric piece on support means or cages, and thereafter a substantially automatic sequence of events occur.

The apparatus includes a substantial number of elements among which are the following: a takeup device that subjects the fabric to the proper combination of tension and properly positions the leading edge of the fabric on the cloth plate of the sewing head, a series of uncurlers which when actuated insure a flat edge, and a folder to create the hem. Further included is a puller which rotates the fabric around the supporting cages and a takeup device to develop the material hem while aligning the leading edge thereof in relationship of tension zones. Also included is a logic system, which upon receipt of the proper inputs from a series of points, starts the actual sewing cycle. As a result of the properly created zones of fabric tension, storing and carrying of the fabric is easily accomplished to achieve the desired results. Thereafter a means, which counts stitches, determines when the hem has been completed and terminates the sewing step, actuates a means which remove the hemmed fabric from the apparatus.

Thus, once the operator properly positions the fabric the apparatus will automatically take over from that point to complete the following operations. The apparatus serves to tension the fabric prior to the creation of the hem forming zones; rotate the fabric to develop the material hem via a folder means, align the edges via sensing means and establish the hem creating zones; actuate a logic system which determines whether or not the proper conditions exist and then starts the sewing machine or repeats rotation of the fabric until proper conditions do exist, determines when the hemming operation has been completed and prepares the apparatus for removal of the hemmed fabric. In the final step the logic system actuates a fabric removal device which removes and stacks the finished product.

It is therefore an object of this invention to provide an apparatus and method for automatically hemming fabric means wherein feeding and tension on the fabric means is controlled to insure the proper hem formation.

Yet another object of this invention is to provide an apparatus and method of automatic hemming in which the subject fabric means is subjected to, and carried in a series of initially formed tension zones.

Still another object of this invention is to provide a method and apparatus for subjecting a horizontally extending fabric tube to different tensions and degrees of gather.

Another object of this invention is to provide a tensioning means, having a series of switch means responsive to fabric tension capable of reversing the direction of travel of said tensioning means.

Yet another object of this invention is to provide an edge alignment device which aligns the fabric edges prior to the start of the sewing operation.

Another object of this invention is to provide an apparatus having an edge alignment device having top and bottom sensors, the separation therebetween being determined by the diameter of the fabric workpiece and a puller which pulls the fabric into a predetermined position with respect to said top and bottom sensors.

Still another object of this invention is to provide a device which feeds material to the fabric folder from a series of fabric tension zones.

Yet another object of this invention is to provide a support means, a tensioning means and a puller means which cooperate to align a fabric edge with respect to a needle center line and create a series of tension zones in order to feed a fabric folder.

Another object of this invention is to provide in combination a fabric support and tension means for creating zones of fabric tension and a puller means which can cause the fabric edge to move in a predetermined manner.

Still another object of this invention is to provide a fabric displacement means for moving a folded fabric edge away from a needle means at the start of a sewing operation.

Yet another object of this invention is to provide a fabric handling means which stretches out curl and displaces a folded fabric edge, away from a needle means at the start of a sewing operation.

Other features of the invention will be made apparent from the following detailed description of the preferred embodiment thereof, with certain variations therefrom being suggested.

The preferred embodiment of the invention, and certain variations, are shown in the accompanying drawings in which:

FIG. 22 is a timing chart showing the work cycle of the various elements;

Figures 1, 8, 9:
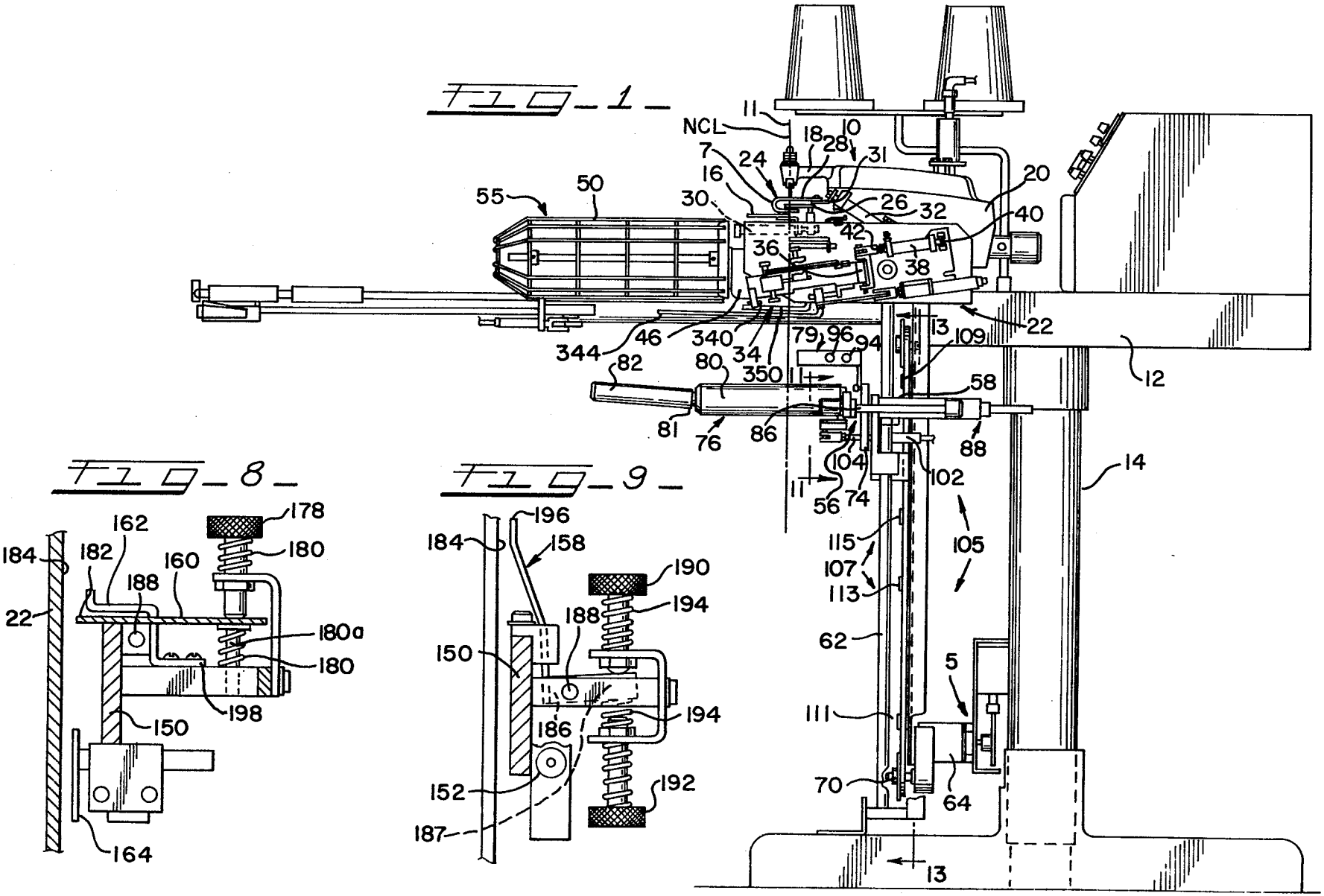
FIG. 1 is a front elevational view of the bottom hemmer apparatus, showing the relationship of the different assemblies.
FIG. 8 is an enlarged view taken along the line 8—8 of FIG. 4.
FIG. 9 is a view taken along the line 9—9 of FIG. 4.

Referring now to the drawings and more particularly to FIG. 1, there is illustrated a conventional sewing machine 10 of the overedge type having a needle center line 11, mounted on a frame means 12 which in turn is supported on an upward column or pedestal stand means 14. Associated with the sewing machine 10, in a customary manner, is a cloth plate 16 and a needle arm assembly means 18 which in turn support the needle assembly and presser foot assembly as will be hereafter described.

Figure 3:
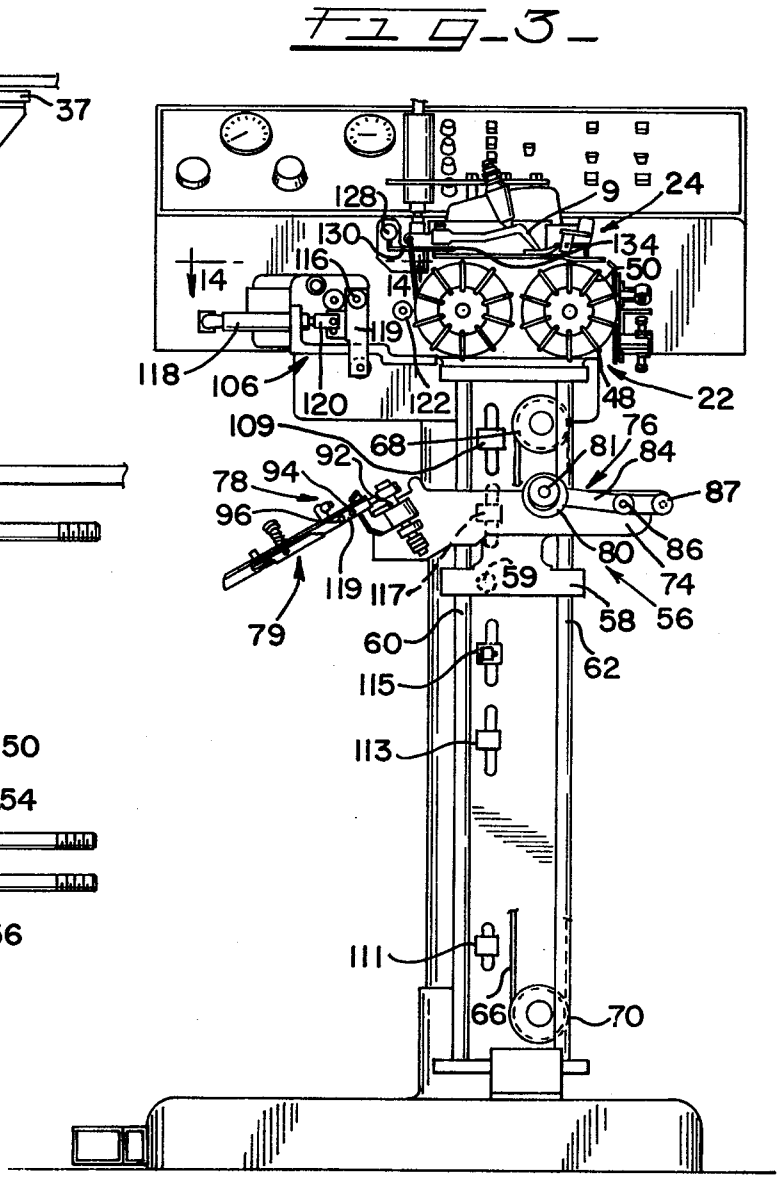
FIG. 3 is a side elevational view of the apparatus as seen from the left of FIG. 1.

In accordance with this invention there is mounted to the front surface 20 of the sewing machine 10 a front or support plate means 22. Carried adjacent the cloth plate means 16 between the front plate means 22 and the presser foot assembly means 9, shown in FIG. 3, is a material folding assembly means 24. Included in the folder assembly means 24 is an inner folder means 26 and an outer folder means 28, each in turn being carried on the rod portion of pneumatic cylinder means 30 and 32. As is apparent, movement of the folder elements will follow the movement of the cylinder rods, the sequential actuation thereof being part of a logic system. The cylinder means 30 and 32 themselves are secured to the sewing machine 10 in any preferable manner. It should be noted that inner folder means 26 moves from left to right as shown in FIG. 1, while outer folder means 28 moves in an upper to lower lefthand manner. The exact angle thereof being variable by modification of the support bracket 31 but in the preferred embodiment the angle is determined by the angle of pneumatic cylinder means 32. When actuating the assembly to begin the folding of a fabric piece the outer folder means 28 is brought into position first, thereafter the inner folder means 26 is actuated to complete the fold. At the end of the hemming cycle, when the folding procedure has been completed, the inner folder 26 is moved to the right prior to the movement of the outer folder 78 in a left upward direction.

Figure 10:
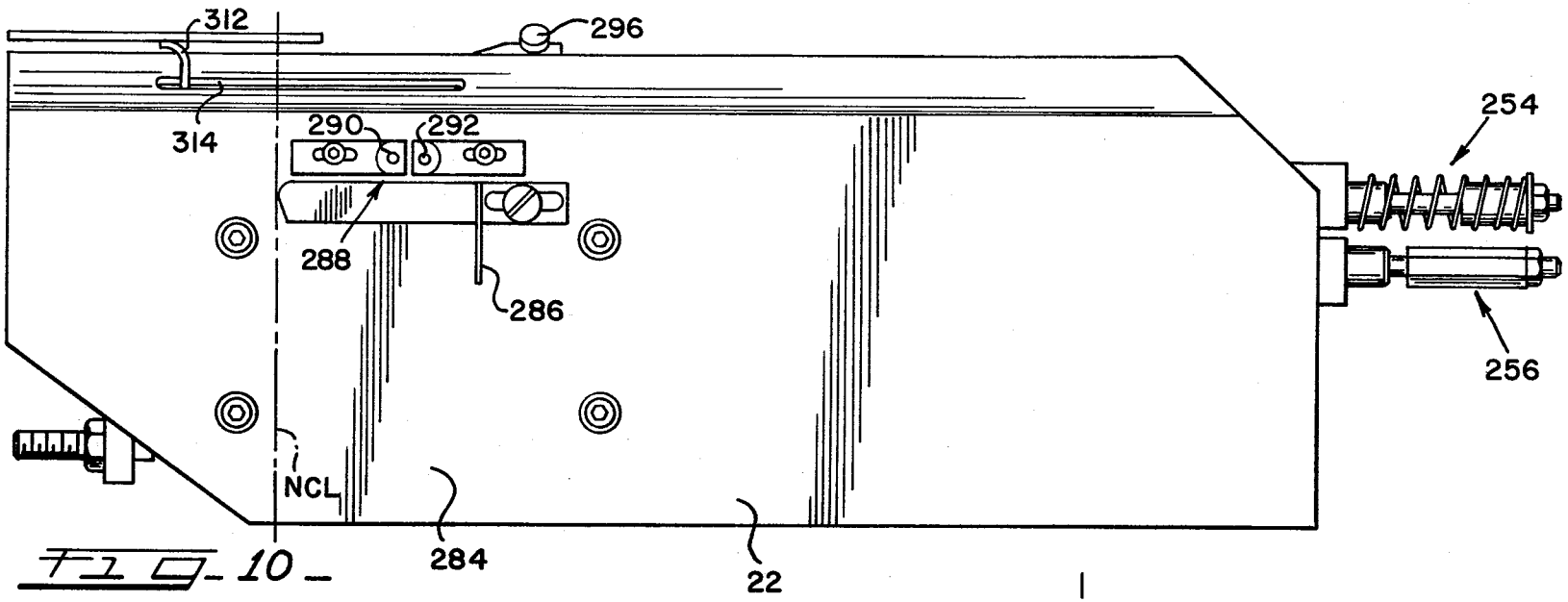
FIG. 10 is a front view of the front plate having all devices removed with the exception of the top sensor and front eject means.

The front plate means 22, as shown in FIGS. 1 and 10, is mounted to the sewing machine 10 in a manner whereby it is slidable either to the right or to the left from a given neutral position. These particular features will be more clearly discussed in conjunction with FIGS. 4, 5, 6 and 7.

Figure 2:
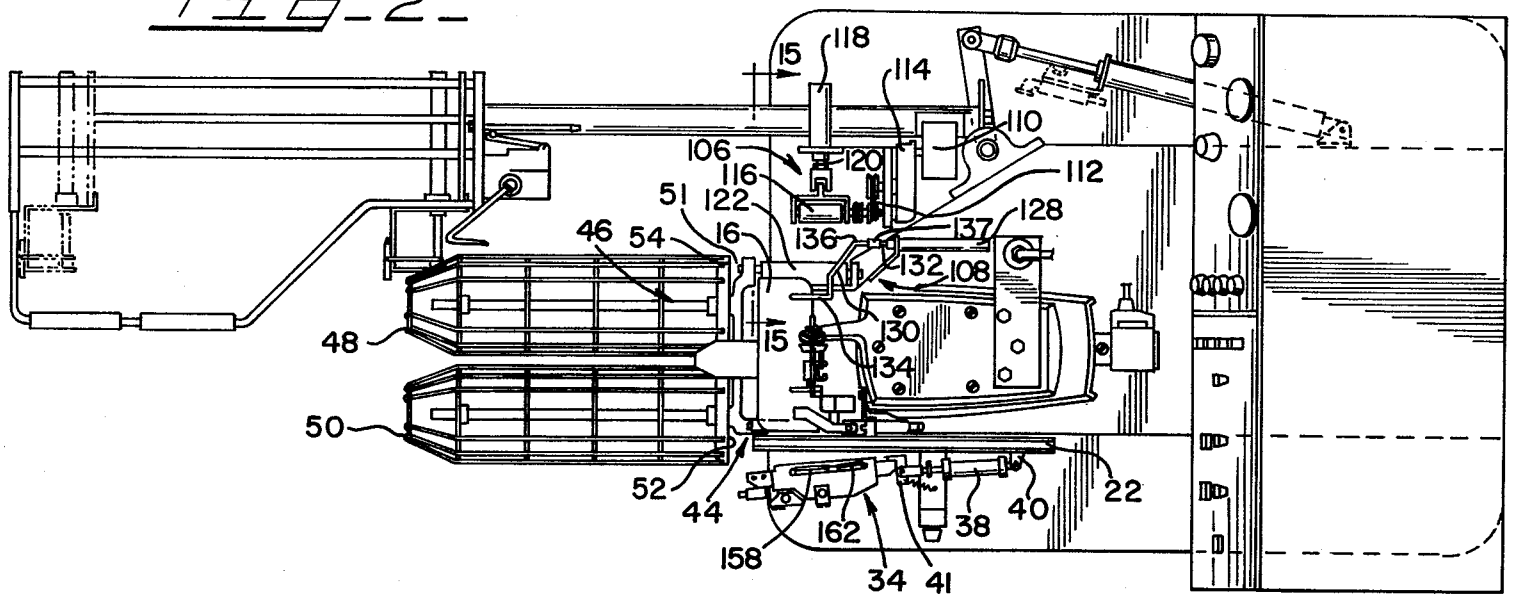
FIG. 2 is a top plain view of the apparatus shown in FIG. 1.
Figure 4:
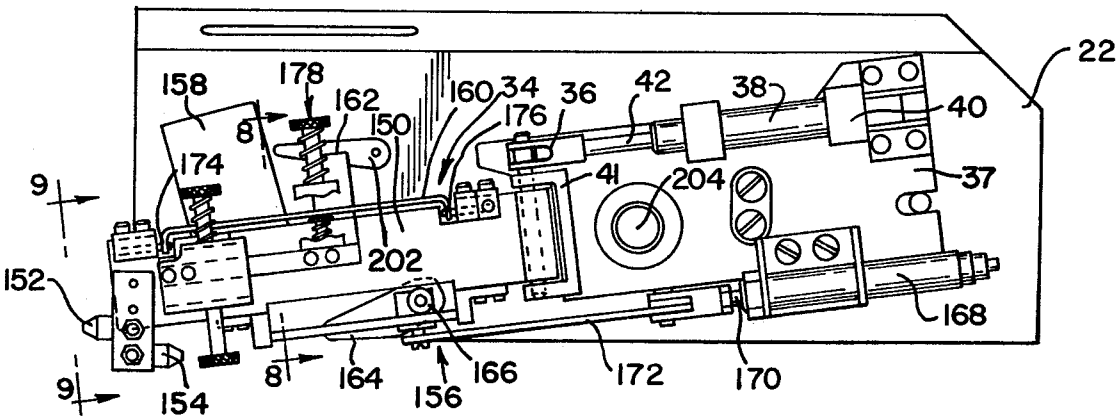
FIG. 4 is a partial front view of the front plate and pivot plate assembly.

On the front plate means 22 is a pivot plate means 34 being pivotally supported by a suitable hinge means 36, which is carried by a mounting plate means 37 operably secured to the front plate means 22 as more clearly shown in FIG. 4, such that pivotal movement therein can be generated by the pivot plate actuating cylinder means 38. The base portion 40 of cylinder means 38 is secured to the front mounting plate means while the rod portion 42 via linkage means 41 serves to pivot the pivot plate means 34 into or out of the plane of the paper as shown in FIG. 4. Referring to FIG. 2, it will be more apparent that pivot plate means 34 is pivotable to and from a position wherein its major plane is parallel with and adjacent to the major plane of support plate means 22.

Associated with the support or front plate 22 and the pivot plate means 34 are a series of uncurler means and pre-hem forming assemblies.

Referring now to FIG. 2 and particularly to the left portion means 44 of the frame means 12, there will be observed a bracket assembly 46 having one end thereof fixedly secured to the frame 12 and a second end thereof supporting rotatable cage or fabric support means 48 and 50. The particular nature of mounting, etc., is such that in the preferred embodiment the two cage means 48 and 50 are freely rotatable and can additionally be driven and have right edge means 52 and 54 spaced away from the cloth plate means 16 and the frame means 12. As a result, a generally open area or gap 51 is formed between the cage means 48 and 50, and the frame 12 and cloth plate 16. Also the two cage means 48 and 50 are generally parallel to each other along their major planes and along their top edges 55. This plane created by the top edges 55 is also substantially parallel with the major plane of the cloth plate means 16 as is shown in FIG. 1.

Figure 13:
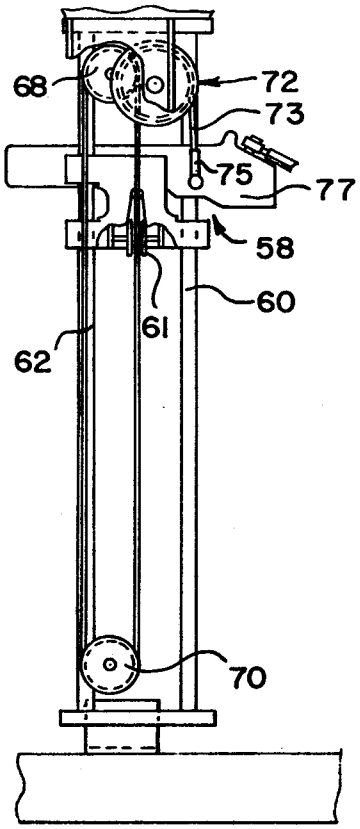
FIG. 13 is a partially broken away view of the fabric tensioning means, shown in FIG. 3.

Positioned below the cage means 48 and 50, and the frame 12 and to the left of the support column means 14 is takeup roller assembly means 56 as shown in FIGS. 1 and 3. Included in the assembly 56 is a carriage means 58 which is retained for movement in an up and down direction by support and guide rods 60 and 62. Movement of the carriage 58 in a vertical direction is achieved by force transferred from a motor means 64 to a timing belt means 66 which is stretched or extended between a free-wheeling roller 68 and a driven roller 70. The belt itself being removably secured at any desired position to the carriage assembly 58 whereby any movement of the belt is followed by the carriage. In a preferred embodiment as shown in FIG. 13 the belt is removable by the use of movable plate means 61 which can be fixed in any desired position with suitable nut and bolt means (not shown). An additional feature of the device includes a motor spin reel assembly 72 having a wire means 73 carried therein such that the pulling out of the wire is resisted by a spring. The free end 75 of the wire means 73 is secured to a rear portion 77 or otherwise appropriately affixed to the carriage means 58. In operation as the carriage means 58 moves downwardly the weight thereof pulls the wire means 73 out of the reel assembly 72, thereby acting against the spring, causing the spring to be progressively loaded to resist further downward movement. As is apparent, this tends to cushion or dampen rapid movement of the carriage assembly 58 and facilitate the subsequent upward movement thereof. That is, upward movement of the carriage 58 is facilitated by the action of the preloaded spring. Secured to an elongated bracket portion means 74 of carriage means 58 is the tension roller means 76 and the rear uncurler assembly 79.

The tension roller means 76 includes first and second roller means 80 and 82. Both roller means are freely rotatable being mounted on the same longitudinally extending support shaft means 81 in an end to end relationship. The first or right roller 80 is pivotally supported via a dog leg or bell crank lever means 84. Referring to FIGS. 1, 3, 11 and 12, it is apparent that bell crank lever means 84 is pivotally supported upon the rod at the end thereof and carries the roll 80 on one arm and a counter balance weight means 87 on the other arm. Actuation of the pneumatic cylinder means 88 will cause the entire roller assembly means 76 to move either to the right or to the left as shown in FIG. 1. This movement is generally in a plane perpendicular to the needle center line 11. Roller means 80 is carried on the shaft means 81 such that its major axis is generally parallel with that of the cage means 48 and 50. The second roller means 82 extends away from roller 88 in a slightly upward direction.

There are a series of switch means used in operation of the present invention. First in this series of switches is a tension unit switch assembly 89, shown in FIG. 11, which is associated with the takeup roller assembly 56 in a manner such that pivotal movement of the bell crank lever 84, as prompted by tension roller assembly 76, actuates or deactuates various associated circuitry. In the preferred embodiment, the takeup roller assembly 56 will be caught and its travel limited by the inside surface of a fabric tube.

Included in tension unit switch assembly 89 is a switch means 91, and a trigger means 93. The trigger means 93 in the preferred embodiment contacts the shaft 95 which supports counterbalance weight means 86, and thus follows the movement thereof over a predetermined range.

Figure 17:
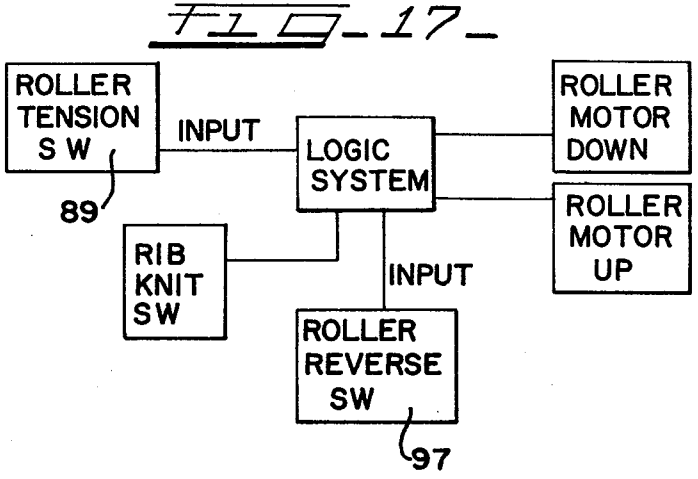
FIG. 17 is an electrical block diagram of the fabric tensioning assembly.
Figure 19:
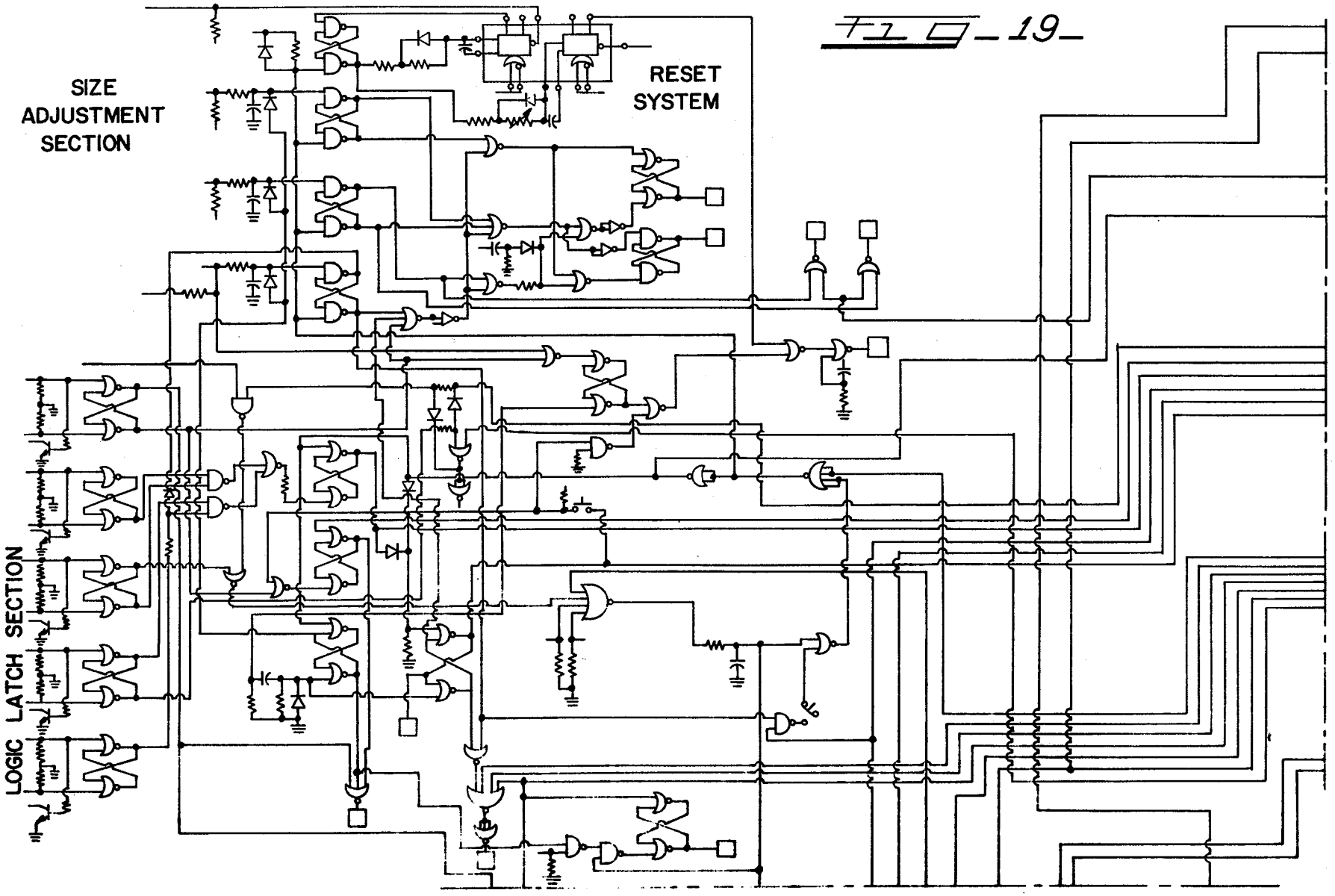
FIGS. 19, 20 and 21 are the portions of one embodiment of a schematic circuit diagram of the logic system.

A simplified block diagram of the associated circuitry appears in FIG. 17 and a schematic circuit diagram of one embodiment appears in FIG. 19.

Figure 11:
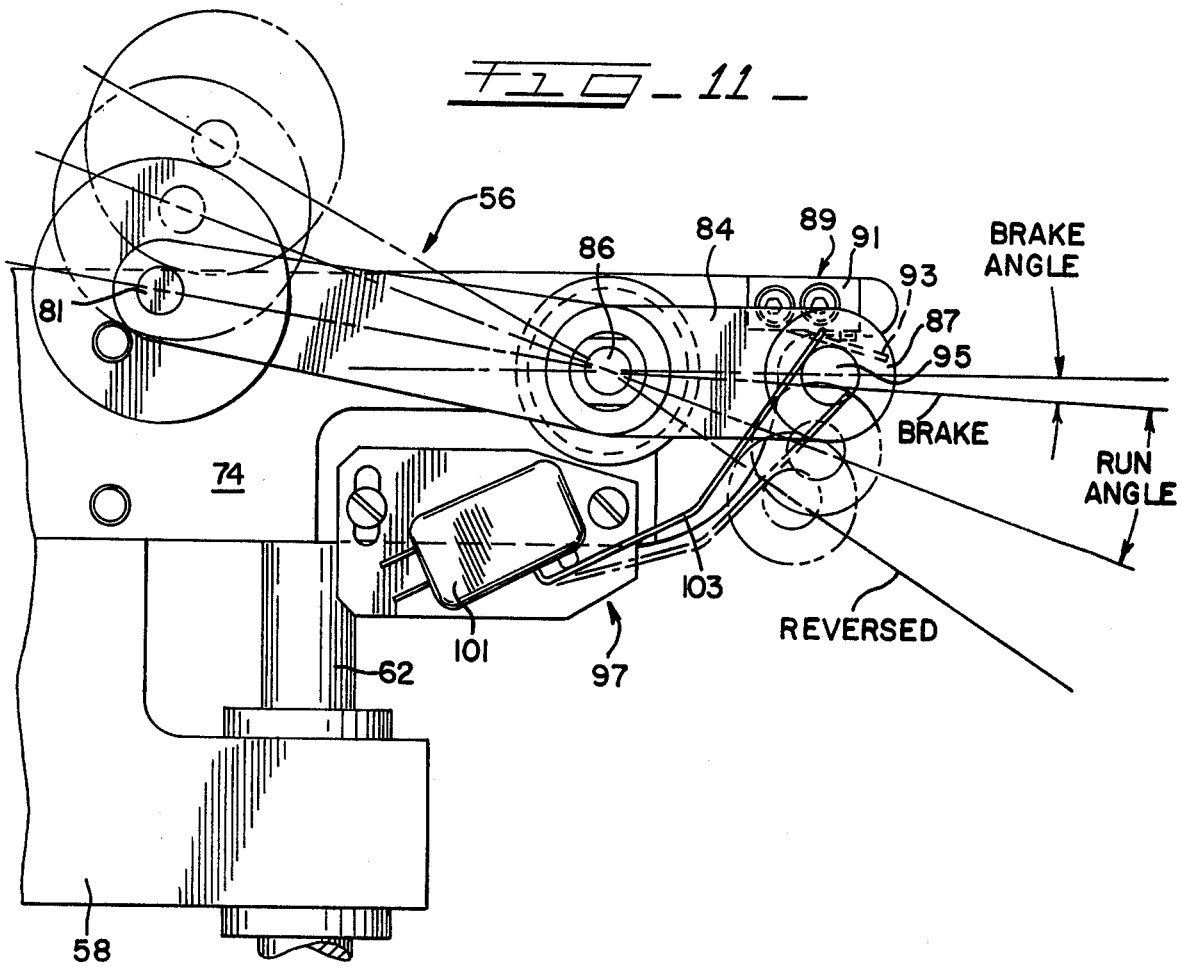
FIG. 11 is a partial view with phantom views showing the positions of the takeup roller means and associated switch series means.
Figure 12:
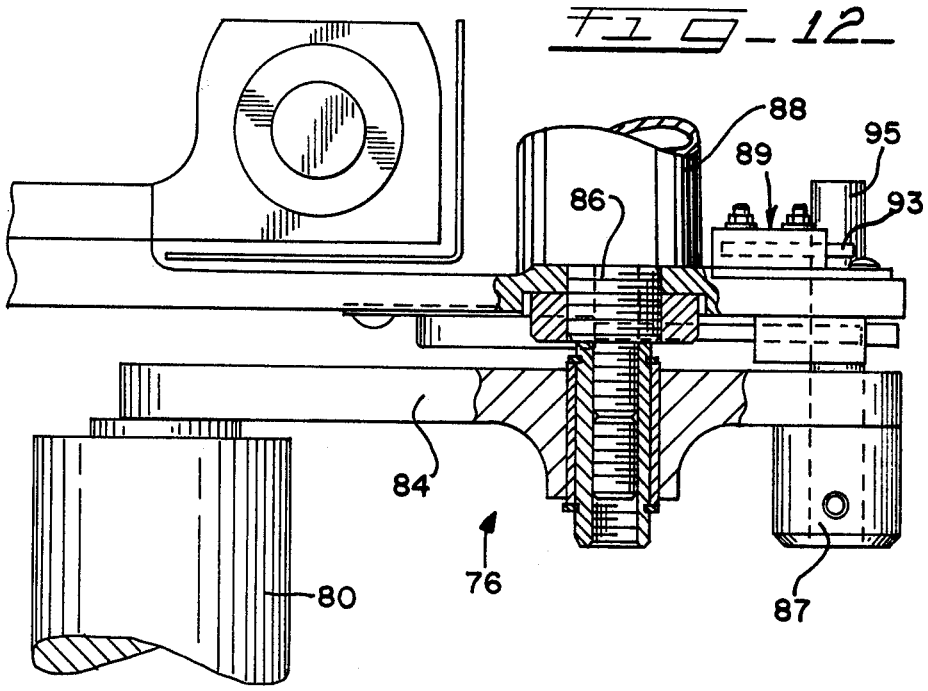
FIG. 12 is a top view of FIG. 11 partially broken away.

In operation the carriage assembly 58 moved down until the tension roller assembly 56 engages the inner side of the bottom of the tubular fabric. As the bell crank lewer means 84 pivots around rod 86, the physical orientation of the trigger means 94 changes sufficiently to actuate switch 89. That is, as shown in FIG. 11 shaft 95 moves down enough to actuate switch assembly 89. Via appropriate circuitry the motor means 64 is deactivated and a brake means 5, shown in FIG. 1 is set.

Also in contact with counterbalance 87 is the second in the series of switch means, which includes a reversing switch assembly means 97. Switch means 97 includes a switch means 101 and an actuating means 103. In the event that the supporting properties of the fabric tube change during the work cycle, that is relax or if the motor overshoots or the brake doesn't hold such that predetermined tension being exerted across the fabric tube decreases, then switch means 97 actuates the motor 64 to drive the carriage 58 downwardly. Any number or combination of these stop and/or down cycles will be initiated by the series of switch assemblies 89 or 97 until the proper predetermined tension zones are created across the fabric means.

Associated with the track means 60 and 62 which carries the carriage 58, are the third and fourth series of switches namely, switch assembly means 105 and 107. The switch assembly means 105 includes a top limit switch 109 and a bottom limit switch 111. Each switch means limits the maximum amount of travel of the carriage 58 in that direction. The switch assembly means 107 includes three switches whose positions are adjustable to any point along the track. These switches 113, 115 and 117 can be positioned such that they are triggered just before tension limit switch 89. Thus, three different size ranges of tubular fabric means such as small, medium and large may be worked with. The size range information being fed into a logic system by whichever switch means 113, 115 or 117 is triggered. The logic system, depending on the fabric size, will in turn make adjustments on other parameters as will hereafter be more fully explained. These three different size ranges thus may be worked upon without any machine adjustment. In the preferred embodiment the switches 113, 115 and 117 are Hall effect switches.

Figure 23:
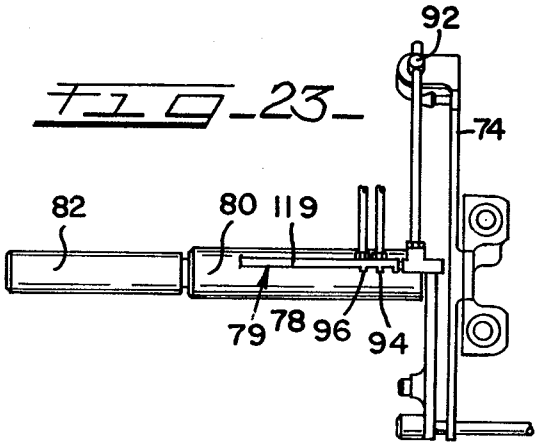
FIG. 23 is a partial top view of the roller takeup assembly.

Turning now to FIGS. 3 and 23 wherein is shown a series of lower sensors, the first of which is sensor assembly means 78 that is carried on the rear uncurler assembly 79. The rear uncurler assembly 79 is in turn pivotally secured at 92 to the bracket means 74. The assemblage 78 comprises a bracket 99 having in the preferred embodiment a series of sensor means for example pressure blower means 94 and 96 carried thereon, which when extended in a work position as shown in FIG. 23 is generally parallel to the major axis of the takeup roller means 80. The first and second or underload and overload pressure blowers 94 and 96 are designed to cooperate with underload and overload sensor means 290 and 292 carried on the front plate means 22, and shown in FIG. 6 which will hereafter be more fully explained. Since pressure blower sensor means are well known, no further explanation will be devoted thereto.

The lower or rear uncurler means 79 as previously stated is pivotally mounted whereby it can be moved with respect to the bracket 74 in the manner of a door hinged to a frame. The movement is achieved by the actuation or deactuation of a pneumatic cylinder means 102 shown in FIG. 1. The pneumatic cylinder means 102 is carried by the frame means 12 in any suitable manner. The rod portion 104 is connected via a suitable linkage means whereby the necessary pivotal movement can be transmitted to the lower uncurler means 28.

Figure 14:
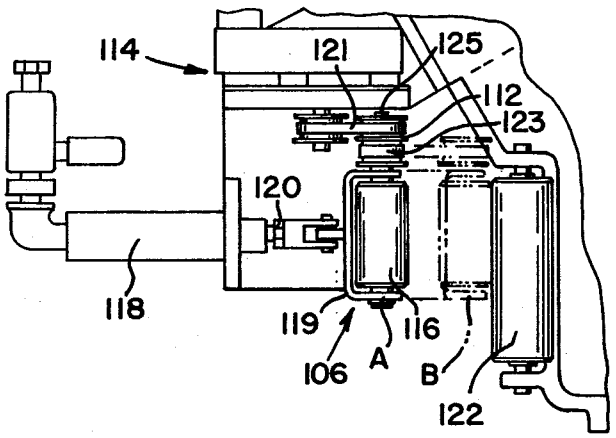
FIG. 14 is a partial view with phantom lines showing the rear puller means in engaged and disengaged positions.
Figure 15:
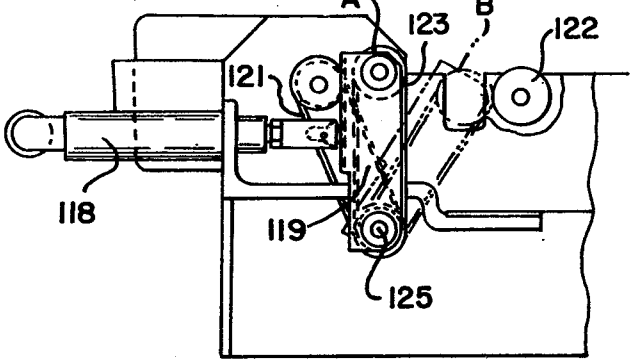
FIG. 15 is a side view of FIG. 14.

Referring now to FIGS. 2 and 3, attention will be directed to the cloth puller means assembly 106 and the rear eject means 108. The cloth puller means 106 includes an electric motor means 110 which via linkage means 112 and transfer case 114 drives a puller roll means 116. A puller roll pneumatic cylinder means 118 suitably secured to the frame means 12 carries the puller roll means 116 via bracket means 119 which is secured to the rod end means 120 thereof. Referring to FIGS. 3, 14 and 15 it is thus apparent that by the actuation of the cylinder means 118 the cloth puller roll can be moved from position A into contact with position B with the cloth puller idler roll means 122, which is also mounted to the frame means 12, whereby it will be freely rotated.

When a tubular fabric has been positioned over the support cage means 48 and 50 and cloth plate 16 it also generally covers the idler roll means 122 and is positioned between the latter and puller roll means 116. Thus, when the puller roll means 116 is actuated, the fabric will be pulled around the supporting cages 48 and 50 via a sandwich relationship with idler roll means 122. The direction in which the edge of the fabric will move with respect to the needle center line is determined by the nature of the tension being exerted there, as will hereafter be more fully discussed.

As best seen in FIGS. 14 and 15, the continued transfer of force between the transfer means 114 and the puller roll means 116 is achieved through the provision of a series of toothed belt means 121 and 123 which allow pivotal movement of the puller roll means 116 without the interruption of force transfer. Toothed belt means 121 transfers force from the transfer case 114 to shaft 125. The puller means 116 and bracket means 119 are both mounted such that they can move around shaft 125 from Position A to phantom Position B as shown in FIG. 15. The toothed belt means 123, in either position A or B transfers force from the shaft means 125 to the puller roller 116.

Located adjacent the cloth puller assembly 106 and on the rear portion of the sewing machine support means 12, as shown in FIG. 2, is the rear eject assembly 108. This assembly includes a pneumatic cylinder means 128 secured to the frame means 12 having an elongated bracket means 130 secured to the rod end 132 thereof. As is apparent, the elongated bracket means 130 as is shown in FIG. 2, will move either to the right or to the left upon the actuation or deactuation of the pneumatic cylinder means 128. The bracket means 130 has a first portion 134 which includes a cloth engaging bend that extends generally out and over the cloth plate means 16. In the preferred embodiment the first portion 134 is directly above and adjacent the cloth plate 16. The second portion means 136 of bracket 130 is secured to rod end 132 of means 128.

In operation, before the presser foot assembly 9 is lowered into contact with the workpiece, and when a fold is formed in the edge of the fabric by the folding assembly means 24 and the fold is pulled under the needle, a bend or curl may be created at the very leading side edge thereof. This bend, in front of the feed dog, if it forms, will not present difficulties since it will be trimmed off by the knife mechanism means. However, the curl in front of the needle and behind the feed dog may create undesirable results if it is not removed prior to initiation of the sewing cycle. Therefore, upon actuation of the rear eject means 108, the fabric in front of the needle and behind the feed dog will not be sewn into the hem since the hem is deflected away from the needle. That is, the second end portion 136 of bracket means 130 is moved to the left by the cylinder means 128 where it engages the fabric and pushes it to the left. The action also stretches the leading edge which tends to pull out the bend. Thus, at the initiation of the sewing cycle of the bottom hemming operation, the raw edge of the workpiece between the knife mechanism and the needle will be moved away from the needle, while any edge material remaining in front of the knife mechanism means will be severed thereby. The logic system retracts the rear eject just prior to the engagement therewith of the sewn hem. The proper retraction is determined by a timed sequence.

Figure 5:
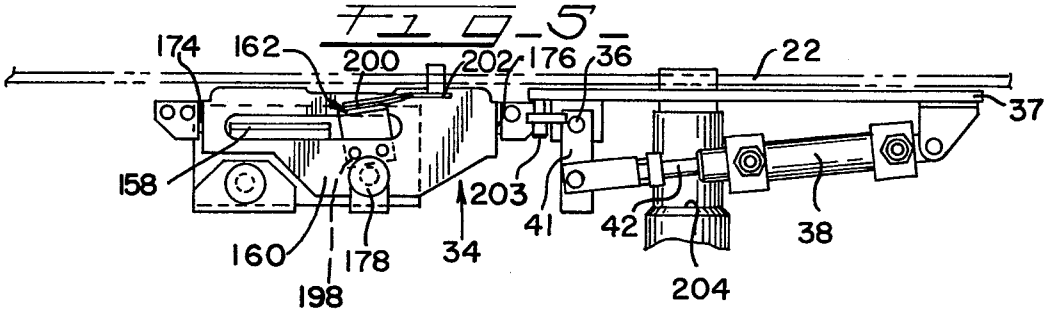
FIG. 5 is a partial top view of the pivot plate and its mounting and actuation.

Referring now to FIGS. 4 and 5, wherein is shown in detail the pivot plate assembly means 34. The pivot plate means 150 is a generally flat elongated plate having thereon a series of elements including an external cage blower means 152, a front uncurler blower means 154, a slide uncurler assembly means 156, a stripper blade means 158, an upper plate means 160, and a hem switch guard means 162. Dealing with each element separately, the slide uncurler means 156 is pivotally mounted under preloaded spring conditions to a slide block system means 166. As is apparent, from a consideration of the elements shown in FIGS. 1, 4 and 8, movement of the slide uncurler plate means 164 against a spring load (not shown) in a rotational manner is possible while movement via the slide system allows movement in a longitudinal manner. For further information, reference should be made to U.S. Pat. No. 3,786,768. A slide uncurler cylinder means 168 having its frame secured to the mounting plate means 37 has its rod end 170, via an appropriate linkage means 172, secured to the sliding block system 166 whereby force may be transferred therebetween. Thus, it is possible to move the slide uncurler bracket automatically to either the right or the left as shown in FIG. 4. This movement is controlled by the logic system. It will be noted as well that the linkage system 172 is of a nature such that force transmission is not interrupted as the pivot plate assembly 34 pivots around pivot shaft means 36. Turning now to the upper plate means 160 as shown in FIGS. 4 and 8, there is included a generally flat plate extending substantially perpendicular the major plane of the pivot plate 150. Suitable bracket means, such as 174 and 176 pivotally secure plate 160 to the pivot plate means 150. A front uncurler adjustment means 178 and a spring means 180 work in combination with free sliding pin **180*a* to control pivotal movement of the upper uncurler plate means 160 around the pivotal support means provided by brackets 174 and 176. This movement is along an axis generally perpendicular to the needle center line. Referring to FIG. 8 it will be apparent that such movement or adjustments allow controlling of the distance between the edge 182 and the surface 184 of the support plate means 22. This distance will be hereafter referred to as the upper plate gap. Turning next to the stripper blade assembly means 158 as shown in FIG. 9, it will be apparent that the generally "L" shaped bracket 186 is pivotally supported on rod means 188. The rod 188 in turn is carried by the pivot plate 150. Position adjust means 190 and 192 are provided adjacent a first end means 187 of the bracket means 186 whereby they can exert a force against the assembly 158 causing pivotal movement around rod 188 to a desired position. Once the proper adjustment range is achieved a spring means 194 is provided to continually urge the second end means 196 into the predetermined relation with the surface 184 of the front plate means 22. The distance will hereafter be known as the stripper blade gap. Adjacent the stripper blade assembly 158 and as may be best seen in FIGS. 5 and 8 is the hem switch guard means 162 which has a first end means 198 secured to the pivot plate means 150 and a second end means 200 running upwardly and to a point adjacent to the hem switch means 202. The hem switch means 202 consists of an elongated plate shaped member being pivotally secured to the front plate means 22. The distance between the vertical portion 200 of the hem switch guard 162 and the plate portions of the hem switch 202 itself will hereafter be referred to as the hem switch guard gap. Located adjacent the pivotal support means 36 is pivot limiting adjustable stop screw 203. Once all gaps, as have been previously described, are determined, the stop screw is moved into a position wherein it abuts the mounting plate 37 when the pivot plate cylinder means 38 is actuated. An additional stop means 204 is provided for adjusting the relative position of the pivot plate assembly 34 in a plane generally parallel to the major plane of the front plate 22. This device works in combination with a screw means having a cammed surface and is located in a slot cut in the rear face of the pivot plate means 150. The nature of the clamping and adjustment assembly means 204 whereby the movement is provided in the pivot plate assembly 34** is similar to the design employed in micrometer type of assemblies, and therefore no further discussion will be made thereof.

Figure 7:
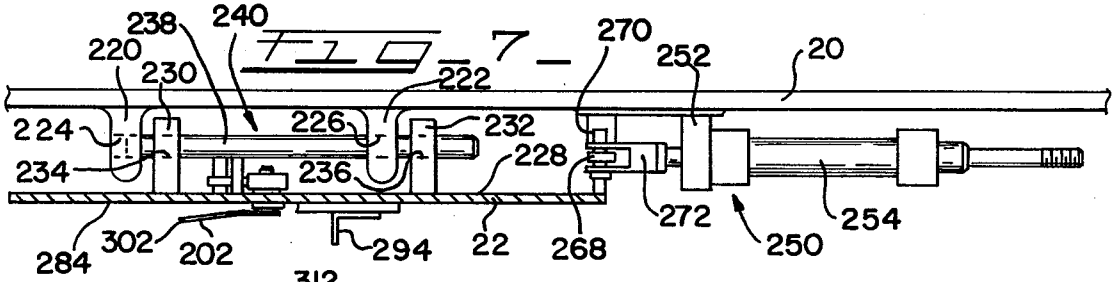
FIG. 7 is a top view of the front plate means as shown in FIG. 6.
Figure 6:
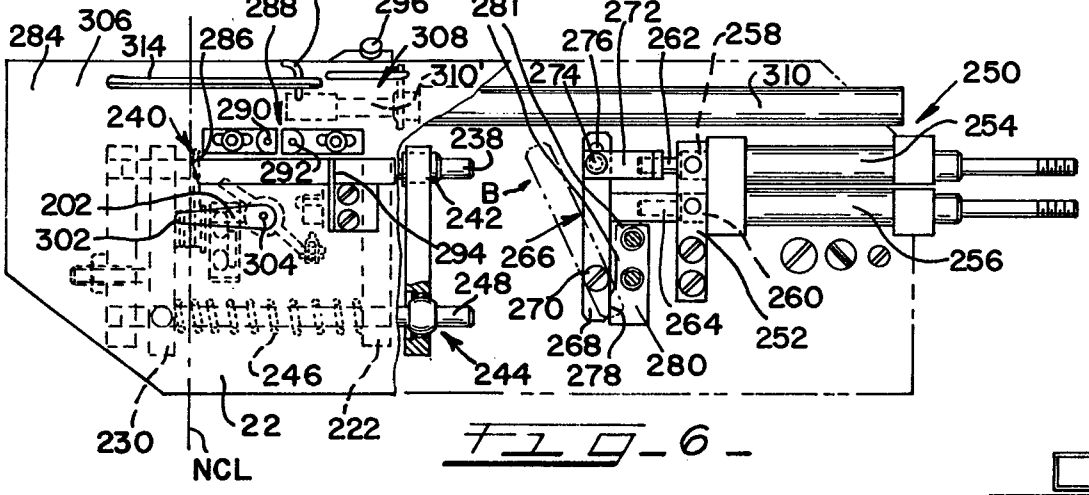
FIG. 6 is a front view, partially broken away, of the front plate means.

The support or front plate means 22 is carried on the machine frame means 20 and in turn, as previously stated, it carries the pivot plate means 34. Referring now to FIGS. 5, 6 and 7 there is more clearly shown the front plate means 22. Extending off the frame assembly means 20, as shown in FIG. 7, are support bracket means 220 and 222. Each is provided with an aperture means 224 and 226. Fixedly secured to the rear surface 228 of the support plate means 22 are first and second bracket means 230 and 232 being provided with apertures 234 and 236 which are substantially identical with apertures 224 and 226. An elongated rod means 238 journals the apertures, previously mentioned, whereby creating a lateral slide assembly meas 240. Bushing assemblies are provided such as 242, wherever necessary in order that the friction between the elements is kept to a minimum. A second bushing assembly 244 is provided, being substantially identical to assembly 240, with the exception that a compression spring means 246 is provided surrounding elongated shaft 248 and sandwiched between the bracket means 230 and 222. When assembled, the sliding means in combination with the front plate 22 create a rigid assembly.

As previously stated, the front plate means 22 can be slid either to the right or to the left on the sliding assemblies 240 and 244 with respect to the needle center line. The return spring means 246, as is apparent, continuously urges the assembly back to a predetermined position.

Adjacent the sliding assembly means 240 and 244 is a slide actuator means 250, which is secured to the frame 20 via a bracket means 252. In the preferred embodiment actuating force is supplied by either a first or second pneumatic cylinder means 254 or 256, which have their respective frame means 258 and 260 appropriately secured to the bracket means 252. The rod end means 262 and 264 via an appropriate linkage assembly 266 can deliver actuating force to the slide assembly whereby the front plate means 22 can be moved to the right against the action of the spring means 246. The linkage assembly means 266 includes a lever means 268 pivotally secured to the frame means 20 at 270 whereby it can be pivoted there around either to the left or to the right. The left pivotal position of lever means 268 being shown in phantom lines as position B. Force is delivered from the appropriate rod means via an extension means 272 to a pin means 274 which in turn is carried in elongated slot 276.

Adjacent the bottom portion of lever 268 is a shoulder section 278 which is in butting contact with a cam shaped bracket means 280 which is secured to the back face 228 of the front plate 22 by any suitable means such as 281. In operation; for example, if lever means 268 is pivoted around pin means 270 into phantom position B, shoulder means 278 will abut cam shaped bracket means 280 and force the entire front plate assembly 22 and sliding assembly means 240 and 244 to be slid to the right as shown in FIGS. 6 and 7. It should be noted that in the preferred embodiment for large shifts of the front plate means 22 pneumatic cylinder means 254 will be employed, while for short shifts pneumatic cylinder means 256 will be employed. The reasons are apparent from a consideration of the relative connection with lever 268 in relationship to the pivot point means 270.

Referring now to FIGS. 1, 6 and 10 there is shown some of the devices carried on the front surface means 284 of the front plate means 22. A front plate edge guide means 286 is located just to the right of the needle center line. Although playing a minor role in assisting in the performing of the hem by establishing the inner side of the blind hem, the primary function of the front plate edge guide means 286 is to prevent the hem, near the end of the cycle, from moving any extent to the right of the needle center line. First sensor series means 288 are provided for sensing the raw edge of the fabric to be hemmed and for providing input to the logic system to actuate the puller means 106 (FIG. 3) for an extent of time until the raw edge is aligned between the upper underload sensor means 290 and the upper overload sensor means 292. The machine actuation button 296 is positioned adjacent the top portion of plate 22. The spring loaded hem switch lever means 202 is mounted adjacent the front surface 284 of the front plate 22 at a point in front of the folding assembly 24 relative the direction of feed. The left tip means 302 of switch means 202 is capable of preforming the inside bottom of the hem and capable of being caught by the finished hem. That is, the switch means 202 allows free passage of the raw edge of the work piece but the tip 302 lies in the path of and is engaged by the folded edge once the fold has been formed and rotated approximately 345°. The engagement of the switch lever tip means 302 200 with the finished hem causes the switch levers means 202 to pivot around support pin 304. The rotational movement of the switch 202 actuates a microswitch assembly (not shown) situated behind the front plate which starts the cycle for the countdown toward machine deactuation.

As best seen in FIGS. 6 and 10, located adjacent the top edge 306 of front plate 22 is a front eject assembly means 308. The front eject assembly 308 includes a pneumatic cylinder means 310 having its body portion secured to the front plate and a lever means 312 secured to the rod end 310. The lever means 312 extends upwardly through an elongated slot means 314 in the front plate means 22. As is apparent, upon actuation of the pneumatic cylinder means 310, the lever means 312 will be moved to the right and upon deactivation to the left, upon completion of the hemming operation, if material is present in the area adjacent the front plate means 22 the movement of the lever means 312 to the left pushes the material to the left and out partially from beneath the presser foot assembly means 9. However, the sewing machine 10 continues to from a thread chain off of the garment. The formed thread chain is drawn into the thread chain cutter (not shown) and severed thereby at the end of the sewing cycle.

Figure 16:
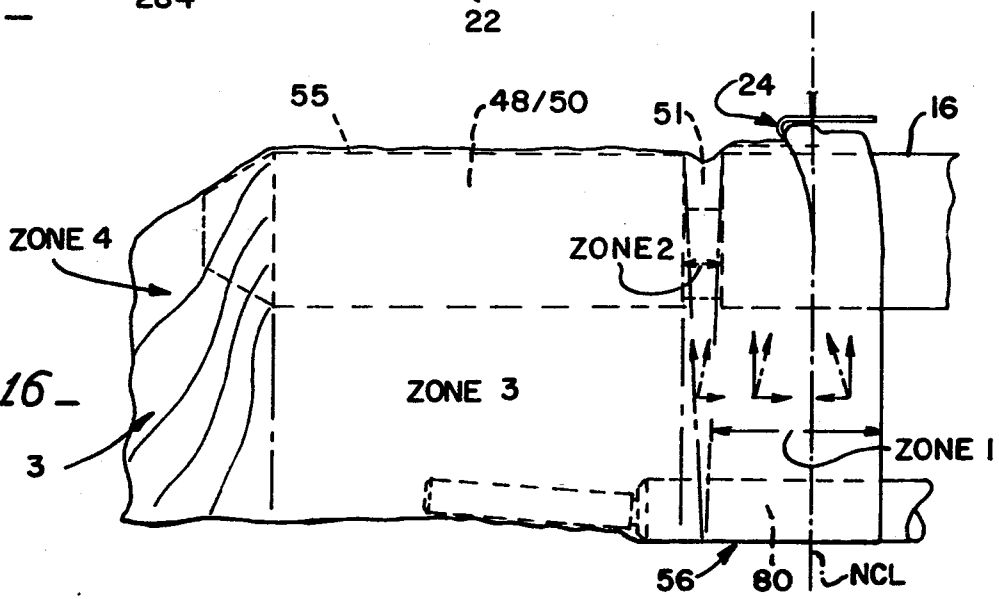
FIG. 16 is a diagrammatic view showing the various tension zones to which the fabric tube is subjected.

Referring to FIGS. 1 and 16 there is shown a partial schematic view of the tension zones which applicant believes provides the proper flow of fabric to the folder assembly means 24. The sequence of events involved in the creation of the zones will hereafter be undertaken for purposes of clarification. Once the fabric tube 3 is properly loaded the start switch 296 (FIG. 10) is actuated, immediately thereafter the hem folder means and pivot plate guiding of mechanisms are actuated. Simultaneously therewith the take-up roller assembly 56 moves downwardly and places tension on the fabric tube 3 as partially shown in FIG. 16. While this is occurring the rear uncurler means 79 is swinging into position with the associated sensor means 94 and 96. The cloth or fabric puller 106 engages and pulls the fabric under the presser foot 9 through the folder means 24 and front plate guide mechanism to preform and position the fabric edge prior to the start of the sewing cycle.

In order to properly create a bottom hem it has been found necesary to feed sheet material from both the left and right of a predetermined point somewhere adjacent the leading edge of the sheets. For example, if it is desired to form a ¾ inch wide hem, with a ⅛ inch seam and to allow 0 to ⅜ of an inch trim-off, approximately 1⅝ to 2 inches of fabric is required. Assume, for example, that the edge of the finished hem lies in the major plane of the needle center line, the material will flow into the hem from both the right and left sides of the needle center line. Of the required 2 inches of fabric, approximately 1¼ to 1⅜ will flow from the right side of the needle center line and the remainder from the left side. Refer specifically to FIG. 16 and tension zone 1 which will be identified as the guiding and folding control zone. Zone 1 is divided by the needle center line (NCL) and thus the fabric therein exhibits a bi-directional feed motion. The material to the right of the needle center line feeds both in line with the machine and toward the left as it flows to form the hem. As will be appreciated, this material, that is the amount of fabric which lies to the right of the needle center line is controlled by the edge sensor means 288 which generates an input to the logic means which controls the actuation of the puller. The puller means by engaging the fabric causes the edge thereof to move to the left. The rate at which the fabric feeds towards the center line is controlled by the sliding friction produced among other things, by the hem folders 24, the stripper blade 158, hem switch 202 and slide uncurler 156. Since each of these items may or may not be present, depending on the design choice, for this explanation a given value can be arbitrarily assigned. As is apparent, however, because of the fact that only a substantially small section of material lies to the right of the needle center line, the mechanical puller means overcomes this friction. Such is not true with the friction generated by the fabric which lies to the left of the needle center line. This material or fabric also flows in line with the feed and has a vector toward the right of the needle center line. But, because a substantial amount of material exists between the needle center line and the other end of the fabric tube, actual movement of the fabric from one end to the other end along its horizontal axis is impractical. Thus it is necessary somehow to initially store material which will be available for feeding into the fold from the left side and yet not allow the large mass of material farther to the left thereof from interfering with the proper development of the fold.

A second tension zone, Zone 2, is designated as the material buffer or storage zone wherein is stored fabric which is to be contributed to the fold from the left of the needle center line. This band of fabric has very low tension and a bi-directional feed motion with the resultant vector toward the needle center line. It is in this zone that the necessary ¾ or ½ inch of fabric is stored for supply to the fold. Here again, the actual rate of flow of the material out of the second tension zone is controlled by the frictional effects of the elements over which it passes. However, Zone 2 provides the necessary material on the left-hand side of the needle center line to develop the hem.

As best seen in FIGS. 2, 3 and 16, the tension in Zone 1 is created and maintained by the fact that roller means 80 generally underlies the needle plate. The roller 80 also just partially underlies the forward part of the fabric support cage means 48 and 50 which, as previously stated, are spaced away from the cloth plate 16 such that a gap 51 exists therebetween. It is this gap where the material or fabric naturally moves when the puller means 106 is initially actuated since it always seeks an area of low tension. As is apparent, the effect of the frictional drag exerted in Zone 1 as well as the distance between the needle plate 16 and the leading edge means 52 and 54 of the fabric support means 48 and 50 as well as the amount of tension exerted on the fabric tube will vary from fabric to fabric. However, simple trial and error can be employed to determine the optimum settings and values.

Turning now to the third tension Zone or the uniform tension zone, the tension on the fabric tube in the third tension zone must be much higher than in any of the other zones because the feed flow has to be generally unidirectional. That is, in a direction generally parallel to the major plane of the needle center line. Theoretically, as the material flows over the fabric support means the feed has no vector in the lateral direction. If the tension in the third tension zone is not sufficient, the free flow of the large amount of material will overcome the parameters controlling material flow in zones 1 and 2. This will result in either pulling material from the folder assembly means 24 to produce and open seam or overloading the folder assembly means causing the crowding thereof.

Depending upon the length of the fabric sheet being worked with, there may or may not be a fourth zone at the end of the support. In the fourth zone the fabric sheet is acted upon by gravity and drapes itself over the end of the cages 48, 50. In the event such a fourth tension zone is present it is called the anti roll-up zone where the tension on the tube 3 is due to gravity.

In operation the fabric tube has an open end which is passed over the cage means 48 and 50 as well as the tensioning roller assembly 56. The leading left edge is brought adjacent a left edge loading positioning means designated generally as 137 in FIG. 2 while the right edge is brought adjacent a right edge loading positioning means 286 (FIG. 10), thereafter the sewing machine actuation button 296 is pressed.

Upon engagement of the machine actuation switch 296, the tension assembly 56 moves downward to create the desired series of tensioning zones on the fabric tube. The upper and lower overload and underload sensor blower means 290 and 292, are actuated. The pressure sensor blowers 94 and 96 which cooperate with the tension roll cylinder means 156 are actuated to align the fabric edge therebetween. The front uncurler blower 154 is also actuated to remove any curl in the top edge as it passes into the folding assembly means 24. The pivot plate cylinder 38 is actuated bringing the pivot plate 34 into a position directly adjacent and in a line generally parallel with the front plate 22. The outer folder 28 moves angularly downward toward the needle for subsequent engagement with the inner folder 26 to create the desired fabric fold. The trim knife blower, bias knife blower and cage separator blowers 152 are actuated, all in preparation of the fabric tube rotation step. The inner fold and a slide uncurler come into play just after the above. Also the front plate makes a shift as determined by the tube size which is in response to the Hall switches 111, 113 and 115 in combination with the tension means. The lower uncurler assembly 28 is pivoted into a position adjacent the lower portion of the fabric tube, and the assemblies associated therewith are actuated.

The actuation of the lower uncurler assembly 79 is delayed slightly in order to allow the tension roller assembly 56 to move into position and to allow air pressure to build up in all the systems such that the edge sensor blowers 94 and 96 are operable as they come adjacent the fabric tube.

It should be appreciated that the fabric tube worked on by the present invention is precut. Ideally, the precut edge of the fabric tube lies in in a plane that forms a perpendicular angle with the major plane (longitudinal axis) of the fabric tube. However, this desireable condition often times is not encountered in practice. What usually results is that the precut raw edge of the fabric tube lies in a plane which is not perpendicular to the major plane (longitudinal axis) of the fabric tube. Thus, if the incorrectly cut fabric tube is arranged over the support cages 48, 50 and over the cloth plate 16 in a manner where the major plane (longitudinal axis) of the tube is perpendicular to the needle center line, the precut raw edge and the plane formed thereby will not be perpendicular to the needle centerline, whereas a wedge portion which is created by the non-perpendicular or non-equal precut edge relative the needle centerline will result. This section of material will, from the side, resemble a triangle. It is this wedged portion of material for which the edge sensors and corresponding fabric edge aligning devices must compensate. That is, a medium point must be found in said wedge such that a maximum amount of the excess material can be cut off by the trim knife and yet such that enough material remains to get complete seam closure all away around the tube.

Assume now that all of the above listed operations have taken place and that the edge of the fabric tube is cut at an angle, the puller assembly 106 is not actuated for a given time period. This action, among other things, rotates the fabric tube around its major axis and in so doing pulls the raw fabric edge to the left of sensor 292. At the same time cylinder means 88 is moving the tension roller assembly 76, and that portion of the fabric tube carried thereby, is moving such that blower means 94 is just uncovered. The puller means terminates operation at the end of a given period at which time the logic system determines whether or not sensor means 94 and 292 are uncovered. If not uncovered, due to the uneven edge angle, etc., the puller assembly 106 is again actuated for a predetermined time. This process is repeated until the logic system determines that sensor means 94 and 292 are uncovered. The logic system also simultaneously therewith checks sensor means 94 and will cause actuation of roller cylinder means 88 if the fabric tube has not uncovered sensor means 94. This action insures that sensor means 94 has not been covered by the action of puller 106 moving a portion of the fabric wedge caused by the improper cutting of the fabric tube. As is apparent, some happy medium is achieved in regard to what portion of the angled fabric edge is adjacent the two different groups of edge sensors. However, enough surplus fabric tube is provided between the two sensor means which comprise each group of edge sensor means. Thus, with the exception of badly cut fabric tubes, a substantial portion of the wide portion of the wedge will be cut off while at the thin portion of the triangle sufficient material will be present such that the same can still be closed.

In the event a fabric tube has been improperly loaded, or has a bottom edge which is very badly cut or in some other way has a defective edge, the fact thereof is sensed by the logic system and all operations of the machine are terminated. Thereafter the fabric must either be aligned, that is removed and realigned or if the problem is so bad that this is impractical then it must be recut or scrapped.

Assuming now that all of the proper impulses are given to the logic system, immediately therewith the rear eject assembly 108 is actuated to bend the fabric behind the presser foot to a point to the left of the needle center line. Thus the sewing cycle can be started without the possibility of sewing any edge curl which exists behind the presser foot and in front of the needle into the hem. Because of the fact that the puller assembly 106 as well as the other hem creating elements have been previously actuated when the edges were aligned, the fold has been created by the folding assembly means 24 and has been drawn under the raised presser foot and needle. Thus, when the presser foot is actuated it engages a properly assembled folded hem. When the sewing machine is actuated the needle and related assemblies begin forming chain and the feed dog pulls material which is immediately fed through the knife just prior to engagement with the needle. In the time that it takes for the handling portion of the knife cut edge to reach the needle, the rear ejector 108 is deactuated allowing the fabric edge to swing to the right and thus lie generally parallel and adjacent to the needle center line where it is immediately engaged by the needle.

Figure 18:
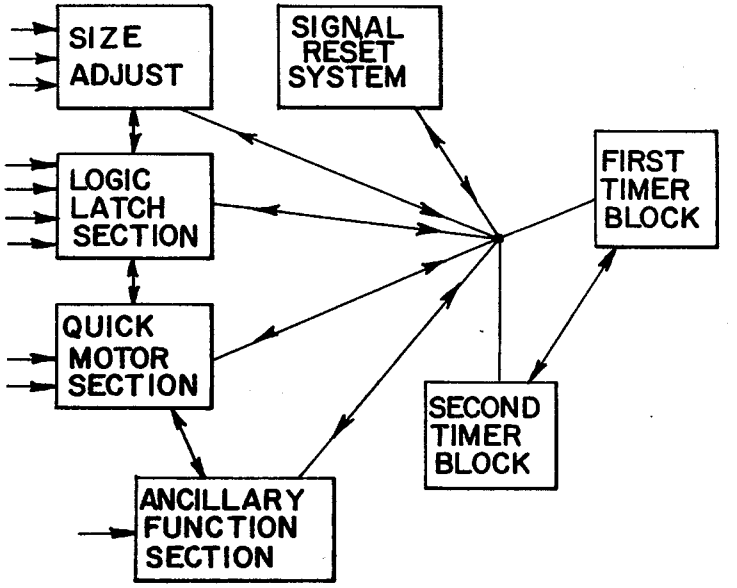
FIG. 18 is a simplified electrical block diagram of the logic system.

Referring now to FIG. 18 wherein is shown a block diagram of the logic system associated with the device hereinunder consideration, it should be appreciated that the discussion relating hereto is of only a general nature since there are a substantial number of different means and modes whereby a logic system for such a device could be constructed. The flow diagram of the logic system hereunder consideration has been broken into sections depending upon their particular function. It should also be appreciated that there is a substantial amount of interrelationship between these sections in this particular embodiment. Simply for the sake of briefness these interrelationships, etc., will not be delved into.

Turn now to the first of these particular sections and in particular the size adjustment section. This particular section receives inputs from the bottom roller assembly means 56 and more particularly from the Hall effect series of switches which are or are not triggered by the passage of a magnet 59 mounted in the roller carriage 58. Depending upon the particular input to this section, certain outputs are generated to facilitate the handling of that particular garment size. The output in turn is employed to move such things as the front plate means 22, either medium or large and the rear eject means 130 either medium or large. Once these parameters have been established, there is no readjustment thereof until the end of the sewing cycle. That is, the information is stored in memory until another garment size is detected. At the end of the sewing cycle there is further input to the section. This input is manifested in output which sets all of the mechanical components controlled thereby to a zero or a neutral state. In this embodiment this zero or neutral state corresponds to that of a small tube.

The next general section into which the logic system can be reasonably divided, is the before logic latch section. In this section a number of inputs, such as from the upper and lower overload or underload assembly 288, 94 and 86 respectively and from the roller tension switch means 89 is received and stored. Tube size information is translated to the appropriate mechanics. A check is made to see that all the proper mechanical adjustments have been performed. Inputs, determinations and decisions regarding the proper alignment, that is inputs from the overload and underload sensors are analyzed and the proper corrective actions or reject actions are taken. It should be appreciated that a majority of these actions take place before the logic latch is activated.

The next section to be discussed is the timer block section. It should be noted that a majority of these actions transpire after the logic latch. However, in the embodiment hereunder consideration a few take place prior thereto. The timer section can be broken up into two blocks of timers. That is, there are a total of 18 timers involved, five of the 18 timers are stitch counting timers and 13 are strict RC timers. That is, some are fixed to a given time while others are adjustable and change with machine speed of stitch length. The adjustable timers are manually adjustable. Specifically for the hemming assembly to work properly when changing from one particular work cycle to another, certain adjustments must be made. In this particular embodiment the necessary variables are set on 5 different counters, that is, the counters store information to be used by the logic system during the performance of the work cycle.

Because of the particular design of this particular logic system, a second timer section was found necessary. This was due because an overlap between two particular functions would occur if all timing sections were combined. As a result, these two functions had to be moved from the main timer section. It should be appreciated that for the most part in normal timer systems the ending impulse triggers the next, i.e., in a sequence nature. This particular timer sequence includes inputs to an auxiliary device, more specifically the fabric ply separator. It allows the ply separator to be activated and deactivated through a work cycle independent of the work cycle of the bottom hemmer.

Yet another section of the logic circuitry is devoted to ancillary function, which includes the seam or hem switch section. This section includes a system which can be activated or deactivated depending upon whether or not the fabric tube being worked with has a side seam. That is, not a true tube but rather a flat garment or series thereof which have been sewn together thereby creating a tube. In the particular logic embodiment shown here upon actuation that is, when a tube with a side seam is being sewn, a circuit is incorporated which allows the first two of three shutdown signals to be ignored by the overall system. These first two shutdowns, it will be appreciated, are generated by the side seams coming into contact with, thereby causing rotation of, the hem switch means 202. On regular tube workpieces the hem switch means 202 is activated only once and therefore when working with garments with side seams the actuation of the switch means 202 by the side seams has to be disregarded since two of the signals received are not representative of the end of the sewn hem.

Yet another feature incorporated into the ancillary section logic is the maximum sew time section. This section is designed to terminate all sewing operations anytime if necessary when the work cycle has progressed to a point where seam switch actuation has malfunctioned.

Although there are a number of reset impulse creating sources situation on the actual bottom hemmer, the reset functions in the block diagram of FIG. 18 will be shown as the "signal reset section." Included among the reset impulse creating means is a manual reset, a reset due to improper loading, a reset due to physical limitations on how small a garment can be sewn, and the requirement that the machine, upon termination, is reactivated in an initial state.

In the particular embodiment of the bottom hemmer sewing system disclosed herewith a drive system incorporating a driving motor is included. The drive system, shown in the block diagram of FIG. 18, is represented as the Quick motor section. The motor drive system incorporates its own set of logic and corresponding inputs and outputs. In order to adopt this system with the logic system hereunder consideration, a drive system innerfaced section is provided.

Figure 20:
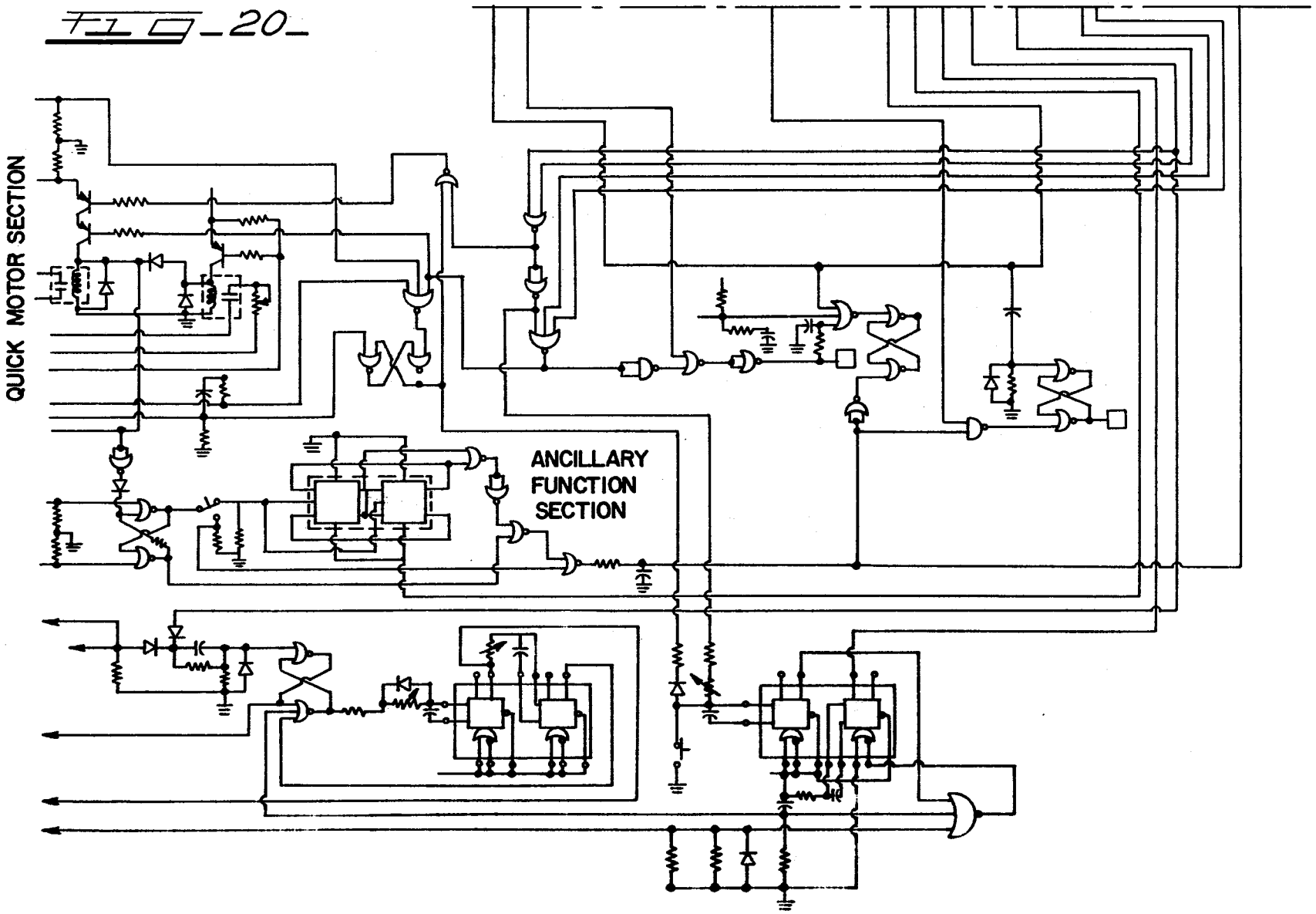
Figure 21:
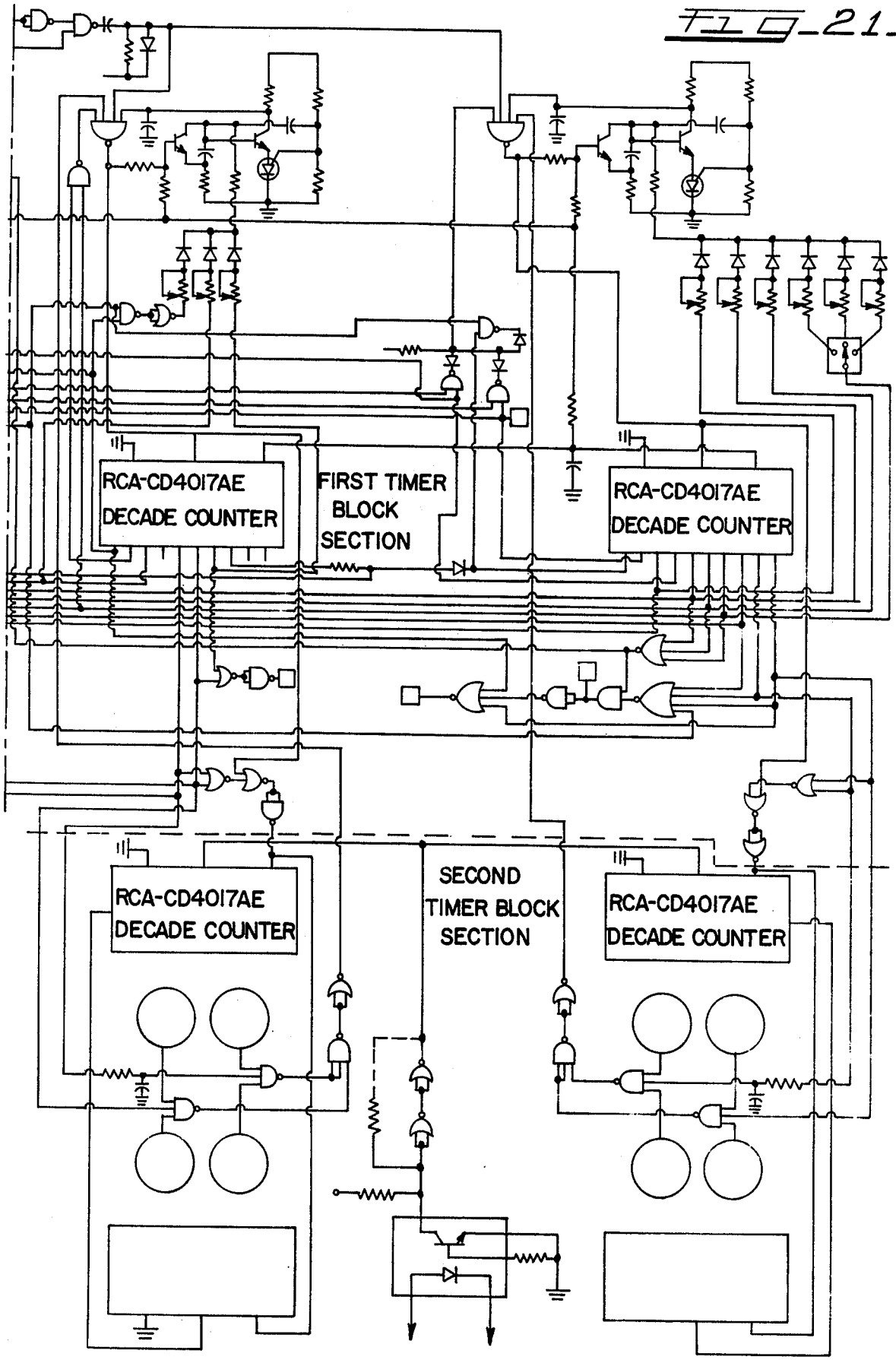

Shown in FIGS. 19, 20 and 21 is one embodiment of a logic system suitable for employment with the invention hereunder consideration. As such no further discussion will be devoted thereto.

Refer to FIG. 22 wherein is shown one embodiment of a mechanical sequence chart for the device hereunder consideration. The elements being actuated or involved include as follows on the horizontal axis: 303 includes the movement downward of the roller means 56; 305 includes the edge sensor means 94 and 96, the underload and overload sensors 290 and 292, and the front uncurler means 154, and the roller cylinder means 88; 307 includes the pivot plate actuating cylinder means 38 and the outer folder means 24; 309 includes the cage separator blower means 344; 311 includes the inner folder means 28; 313 includes the large front plate means 22 for medium pieces; 315 includes the large front plate means 22 for large pieces, 317 includes the lower uncurler means 102; 318 includes the puller means 106; 320 includes the small, and medium rear ejector means 108; 322 includes the large rear ejector means 108, 324 includes the presser foot means 9, the slide uncurler means 156; 326 includes the sewing machine drive motor 10; 328 includes the internal cage blower means 350, the external cage blower means 152; 330 includes the front eject means 308; 332 is the movement upward of the roller motor means 56; and 334 is the clamp cage blower means. It should be noted that in the case of the front plate medium or large only one element of the two will be activated. The same is true of the rear ejector means, only one thereof will be activated. In each case the particular size of the garment being hemmed will determine which elements will be activated.

On the vertical axis of FIG. 22 the following states exist: at 354 the bottom hemmer assembly is activated via switch means 296; by state 356 all tensioning of the fabric tube has been accomplished. At state 358 the logic latch assembly is satisfied; at point 360 the sewing machine 10 begins its operation and at point 362 all sewing operations terminate and hemming assembly returns to a reset position to begin the next cycle.

While various embodiments of the invention have been disclosed in the foregoing, it should be understood that these are simply illustrative of the novel features of the invention, and other forms of certain aspects of the invention may be utilized within the scope of the claims hereinafter presented.

What is claimed is:

1. An apparatus in combination with a sewing machine which has a needle means and a cloth plate means having the needle center line passing therethrough, for sewing a hem on a tubular fabric means comprising:

freely rotatable material support means adjacent to and spaced away from said cloth plate having a major axis generally parallel and coextensive with a major axis of said cloth plate;

freely rotatable material tensioning means adjacent to and spaced away from said material support means, said tensioning means and said support means having generally parallel major axes, said axes being generally perpendicular to the major axis of said needle center line, said tensioning means including inner and outer portions, said inner portion having first and second section means, said first section situated generally below said cloth plate and said second section situated generally below and to the side of said cloth plate whereby a series of tension zones are achievable during operation of said apparatus; and a material puller means positioned adjacent said needle means actuatable for initiating a material hem and causing material flow to form said zones of tension.

2. Sewing machine apparatus for bottom hemming tubular material comprising:

a needle means;

a cloth plate means having an edge means, a needle center line passing therethrough; and support means and tension means cooperating with said material whereby it assumes a tubular configuration, said support means includes an edge means and has a major axis generally perpendicular to said needle center line, said tension means including inner and outer portion means, a first section means of said inner portion is spaced below said cloth plate and cooperates therewith to subject said material to a first tension zone, a second section means of said inner portion cooperates with a leading edge of said support means and an edge of said cloth plate adjacent said support means to subject said material to a second tension zone, and said outer portion cooperating with said support means to subject said fabric to a third tension zone.

3. The sewing machine apparatus of claim 2 including:

a folder means positioned in front of said needle generally on said needle center line; and means for pulling said material initially around its major axis whereby material flows over said support, tension and cloth plate means to create said zones, and into said folder to create an unsewn bottom hem.

4. The sewing machine apparatus of claim 2 wherein:

fabric in said first tension zone is subject generally to bi-directional forces;

fabric in said second tension zone is subject generally to bi-directional forces; and fabric in said third tension zone is subject generally to unidirectional forces.

5. The sewing machine apparatus of claim 2 wherein:

said edge means of said support means is spaced away from said edge means of said cloth plate means.

6. Method for bottom hemming tubular material with a sewing machine including a stitch forming instumentality comprising the steps of:

supporting said material on a support and cloth plate means in a tubular configuration;

tensioning said tubular configured material for subjecting it to first, second and third tension zones;

pulling said tubular configured material causing it to flow into a folder means and into said first, second and third tension zones;

deactuating the puller means and actuating means associated with a sewing machine for feeding fabric past the stitch forming instrumentality; and sewing closed said folded bottom hem.

7. An apparatus for hemming a tubular fabric means comprising in combination a sewing machine with an eject means for avoiding the sewing of edge curl into an initial length of the fabric hem, said apparatus comprising:

a sewing machine head means for performing a stitching operation along the edge of a fabric section, including a knife means, a presser foot means, and a needle means;

folder means operative to create a folded fabric edge position in front of said sewing head means;

fabric puller means positioned adjacent said sewing head for pulling fabric through said folder means whereby a hem is formed and pulled adjacent said knife means, and under said presser foot means and said needle means such that a curl is formed in the leading edge of said hem; and means operative to engage said hem with said curled edge, and to distort it to generally stretch said curled edge out of said hem and to move said hem generally out from under said needle prior to actuation of said sewing machine head.

8. The apparatus of claim 7 wherein said fabric puller means is operative to move said fabric, prior to actuation of said sewing head means, whereby an untrimmed edge is orientated with regard to said sewing head for stitching; and further includes a lever means operative to engage said untrimmed fabric hem whereby said hem is generally stretched and generally bent out from under said needle during the initial actuation period of said sewing head.

9. A sewing machine apparatus having a needle center line for positioning tubular material prior to hemming thereof in combination with a fabric edge positioning device comprising:

a supporting means carrying said tubular material in a tubular configuration;

a tensioning means cooperating with said sewing machine and said supporting means whereby said tubular material is subjected to a series of tension zones;

a means operative to pull said tubular fabric around its major axis prior to actuation of said sewing machine;

first and second sensor set means positioned generally on opposite sides of said fabric tube for monitoring the position of the two opposite edges of said fabric tube;

means operative to move said tensioning means generally laterally with regard to said needle center line; and means responsive to input from said first sensor means for actuating said means operative whereby moving said tensioning means laterally to the needle center line, and also responsive to input from said second sensor to actuate said means operative to pull said tubular fabric whereby said fabric edge all the way around the tube is positioned in a predetermined location with respect to said needle center line prior to actuation of said sewing machine.

10. The fabric edge positioning device of claim 9 wherein:

said tensioning means includes size sensing means producing an output characteristic of the diameter of said tubular material; and said actuating means are responsive to said output characteristic whereby adjustments are made to said sewing machine apparatus.

11. Sewing machine apparatus having a means for hemming tubular fabric means comprising:

support means capable of having the tubular fabric means positioned thereover;

tensioning means;

means operative to move said tubular fabric means;

means mounting and automatically moving said tensioning means to the side of said tubular fabric means opposite that supported by said support means;

first and second sensor series means each including first and second sensors, a first plane passes between said first series and is parallel to the needle center line and lays to one side thereof, a second plane passes between said second series and is parallel to said needle center line and lays at a predetermined point between said needle center line and said first plane; and means receiving input from said first and second sensor series whereby controlling said tensioning means and said means operative to move said tubular fabric means.

12. In combination with a sewing machine having a support means, a needle means and a needle plate means, an apparatus for forming a hem on the edge of a tubular fabric means, said apparatus comprising:

fabric support means positioned adjacent said sewing machine and having a top surface means generally parallel with the needle plate means of said sewing machine and spaced away therefrom;

folder means positioned adjacent the needle plate means and in front of said needle means for forming a fold on the edge of said tubular fabric means; fabric tensioning means having a portion adjacent both said support means and said needle plate means and including means for creating three different zones of tension in said tubular fabric at least adjacent said support means and said needle plate means; and fabric puller means for moving the tubular fabric means, said fabric puller means being carried by said support means and said needle plate means, said fabric puller means moving said tubular fabric means, which is under tension, through said folder means whereby creating a fold and causing said tubular fabric means to be subjected to said three zones of tension the first and second thereof supplying material to form said fold and the third tensioned to the extent that horizontal movement is prohibited.

13. A method for hemming a tubular fabric edge comprising the steps of:

passing a support cage means and tensioning roller means into said tube;

positioning the leading edge of said fabric inwardly of the needle center line of a sewing machine spaced apart from said support cage;

actuating said tensioning roller means subjecting a leading portion of said fabric adjacent said needle center line to variable tension subjecting a second portion between said cage means and said sewing machine to minimal tension and subjecting a third portion adjacent said cages to uniform tension;

aligning the fabric edge adjacent the tensioning roller with the needle center line;

pulling fabric through a folder means whereby drawing fabric inwardly to the needle center line from the zone of minimal tension, and from the right of the needle center line, and aligning the fabric edge adjacent the folder with the fabric edge adjacent the tensioning roller;

bending the fabric out from under and behind the needle means;

actuating the presser foot means starting the sewing machine and sewing the hem; and ejecting the hemmed fabric tube from adjacent the needle center line.

14. A sewing machine having a needle means and a cloth plate means for performing work on a tubular fabric means and having an ejection means for deflecting said tubular fabric means away from the needle means during the initial stages of the work cycle thereof comprising:

a lever means located adjacent the needle means capable of exerting deflecting force on only an edge of said fabric means positioned on said cloth plate means;

means operative to deliver force to said lever means; and means causing actuation of said lever means prior to actuation of said work performing instrumentality and deactuation thereof after a predetermined cycle.

15. A sewing machine apparatus in combination with a tubular fabric tensioning means for tensioning a fabric means such that a work cycle can be performed thereon comprising:

a carriage means capable of moving along a predetermined path;

a fabric engaging means mounted on said carriage in a following manner and responding to tension on said tubular fabric means;

a series of switch means controlled by the response of said fabric engaging means; and a force transfer means capable of moving said carriage means along said predetermined path in response to said series of switch means.

16. The fabric tensioning means of claim 15 wherein:

said carriage moves along a track means;

said fabric engaging means includes a lever means movably secured to said carriage means; and said force transfer means includes an electric motor means.

17. A sewing machine apparatus in combination with a fabric tensioning means for tensioning a tubular fabric means such that a work cycle can be performed thereon comprising:

a carriage means capable of moving along a track means;

a lever means movably secured to said carriage means in a following manner, said lever means engages said fabric means and is movable to either a first or second position depending on the tension to which said fabric is subjected to;

a force transfer means including an electric motor means capable of moving said carriage means along said track means; and a series of switch means controlled by the response of said fabric engaging lever means, said series of switch means includes first and second switch means, said first switch means activating said motor means to drive said carriage in a first direction and said second switch means activating said motor means to drive said carriage means in a second direction.

* * * * *